US005934889A

United States Patent [19]

Muraki

[11] Patent Number: 5,934,889

[45] Date of Patent: Aug. 10, 1999

[54] PUMP DRIVEN BY CAM HAVING THE CYLINDER SUPPORTED BY THE CAM SHAFT

[75] Inventor: Motohito Muraki, Nagoya, Japan

[73] Assignee: Brother Kogyo Kabushiki Kaisha, Nagoya, Japan

[21] Appl. No.: 08/700,787

[22] Filed: Aug. 21, 1996

[30] Foreign Application Priority Data

Aug. 25, 1995 [JP] Japan ..... 7-217893

[51] Int. Cl.[6] ..... F04B 19/22

[52] U.S. Cl. ..... 417/488; 417/487; 417/486; 417/360

[58] Field of Search ..... 417/360, 488, 417/487, 486; 92/166

[56] References Cited

U.S. PATENT DOCUMENTS 57,190 8/1866 Root ..... 92/166

4,922,805 5/1990 Beswick ..... 92/166

5,317,873 6/1994 Okuda et al. ..... 60/487

FOREIGN PATENT DOCUMENTS

A-8-174853 7/1996 Japan .

*Primary Examiner*—Timothy S. Thorpe
*Assistant Examiner*—Ehud Gartenberg
*Attorney, Agent, or Firm*—Oliff & Berridge, PLC

[57] ABSTRACT

A pump for performing suction and discharge of a liquid, including: a cylinder supported at at least a first support point and a second support point; a piston slidably disposed in the cylinder and forming a pump chamber having a volume changeable by sliding movement of the piston; a drive shaft, the piston and the drive shaft moving in association with each other; a cam in contact with the drive shaft so that rotation of the cam drives the drive shaft to move, the piston sliding within the cylinder in association with movement of the drive shaft to perform suction and discharge of a liquid; and a cam rotational shaft rotatably supporting the cam and disposed at the first support point.

28 Claims, 7 Drawing Sheets

PUMP DRIVEN BY CAM HAVING THE CYLINDER SUPPORTED BY THE CAM SHAFT

BACKGROUND OF THE INVENTION

1. Field of the Invention

The present invention relates to a pump wherein a piston is slid within a cylinder to produce positive and negative pressure to suck and discharge ink from, for example, nozzles of an ink jet print head in an ink jet printer.

2. Description of the Related Art

Suction pumps have been used to clean nozzles of an ink jet type printer to prevent clogging of the nozzles or to unclog clogged nozzles. The suction pump includes a cylinder and a piston slidably disposed within the cylinder. The cylinder and the piston form therebetween a pump chamber with variable volume depending on the sliding position of the piston.

Japanese Patent Application (KOKAI) No. HEI-8-174853 describes the conventional suction pump shown in FIG. 1. The suction pump includes a cylinder 208, two pistons 200, 201, forming a pump chamber in the cylinder, drive shafts 202, 203, which are linked with the pistons 200, 201 respectively, and a suction tube 209 fluidly connected with the interior of the cylinder. A cam 204 driven to rotate in a direction indicated by an arrow A is provided with cam grooves 206, 207. Tips of the drive shafts 202, 203 are connected with the cam grooves 206, 207 respectively so as to be guided thereby. By changing the interval and position of the two pistons 200, 201 in the cylinder 208, a negative pressure develops in the suction tube 209. Although not shown in the drawings, the suction tube 209 is connected to a suction cap which can be brought into intimate sealed contact with ink jet nozzles formed in a print head of an ink jet type printer. When the negative pressure develops in the suction tube 209, ink and undesirable material mixed therein is sucked from the ejection nozzles and discharged to a liquid waste foam (not shown in the drawings).

The drive shafts 202, 203 are connected to respective cam grooves 206, 207 by pins 210, 211 provided to the respective drive shafts 202, 203. In association with rotation of the cam 204, the pins 210, 211 follow the side surfaces 206*a*, 206*b*, 207*a*, and 207*b* of the cam grooves 206, 207 so that the pistons 200, 201 move reciprocally within the cylinder 208.

However, during pumping operations, not only do the drive shafts 202, 203 move reciprocally in an axial direction of the drive shafts 202, 203 indicated by an arrow B, but rotation of the cam 204 also applies to the tips of the drive shafts 202, 203 a large vertical force in a right angle direction, that is, a direction indicated by an arrow C, which is perpendicular to the axial direction of the drive shafts 202, 203. Because the drive shafts 202, 203 protrude from the cylinder 208 toward the cam 204, the force applied to the pins 210, 211 of the drive shafts 202, 203 in the direction indicated by the arrow C swings or vibrates the tips of the drive shafts 202, 203 so that the shafts can become shifted out of proper alignment.

As shown in FIG. 1, the cam 204 is supported on a support member 212. A swing stop plate 214 for preventing the drive shafts 202, 203 from swinging in the direction indicated by the arrow C is formed from a portion of the support member 212. A great deal of vibration is prevented by the swing stop plate 214.

SUMMARY OF THE INVENTION

However, the support member 212 is a separate member from the structure forming the cylinder 208 so that the drive shafts 202, 203 can be installed with only limited precision. It therefore becomes difficult to assemble the suction pump so that the drive shafts 202, 203 are supported in a desired orientation.

The vibration of the drive shafts 202, 203 in the cylinder 208 can change volume in the pump chamber formed between two pistons 200, 201 and the cylinder 208. Also, vibration of the drive shafts 202, 203 can bring the pins 210, 211 out of phase with respect to the cam 204. These problems can cause discrepancies in suction and discharge timing so that pumping cannot be accurately or precisely controlled.

The vibration in the direction indicated by the arrow C can also be propagated to the cylinder 208 by way of the pistons 200, 201 or the cap 216 in which the drive shafts 202, 203 are disposed. When the cylinder 208 itself vibrates, vibration of the drive shafts 202, 203 increases so that a great discrepancy in suction and discharge timing can result.

The cylinder 208 is supported at only one end by the support portion 220 on a frame 218. When a force is applied near the tips of the drive shafts 202, 203, the drive shafts 202, 203 act as levers and apply a great force to the support portion 220. Accordingly, the cylinder 208 needs to be sturdily attached to the support portion 220. This limits freedom of design of the pump system so that manufacture costs can increase.

Because the support member 212 for supporting the cam 204 and the support portion 220 for supporting the cylinder 208 are attached separately to the frame 218, accurate and precise assembly of the position of the pins 210, 211 with respect to the cam 204 is extremely difficult.

It is an objective of the present invention to overcome the above-described problems and to provide a pump wherein a cam and a cylinder can be accurately, easily, and precisely installed.

To achieve the above-described objectives, a pump according to the present invention includes: a cylinder supported at at least a first support point and a second support point; a piston slidably disposed in the cylinder and forming a pump chamber having a volume changeable by sliding movement of the piston; a drive shaft, the piston and the drive shaft moving in association with each other; a cam in contact with the drive shaft so that rotation of the cam drives the drive shaft to move, the piston sliding within the cylinder in association with movement of the drive shaft to perform suction and discharge of a liquid; and a cam rotational shaft rotatably supporting the cam and disposed at the first support point.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
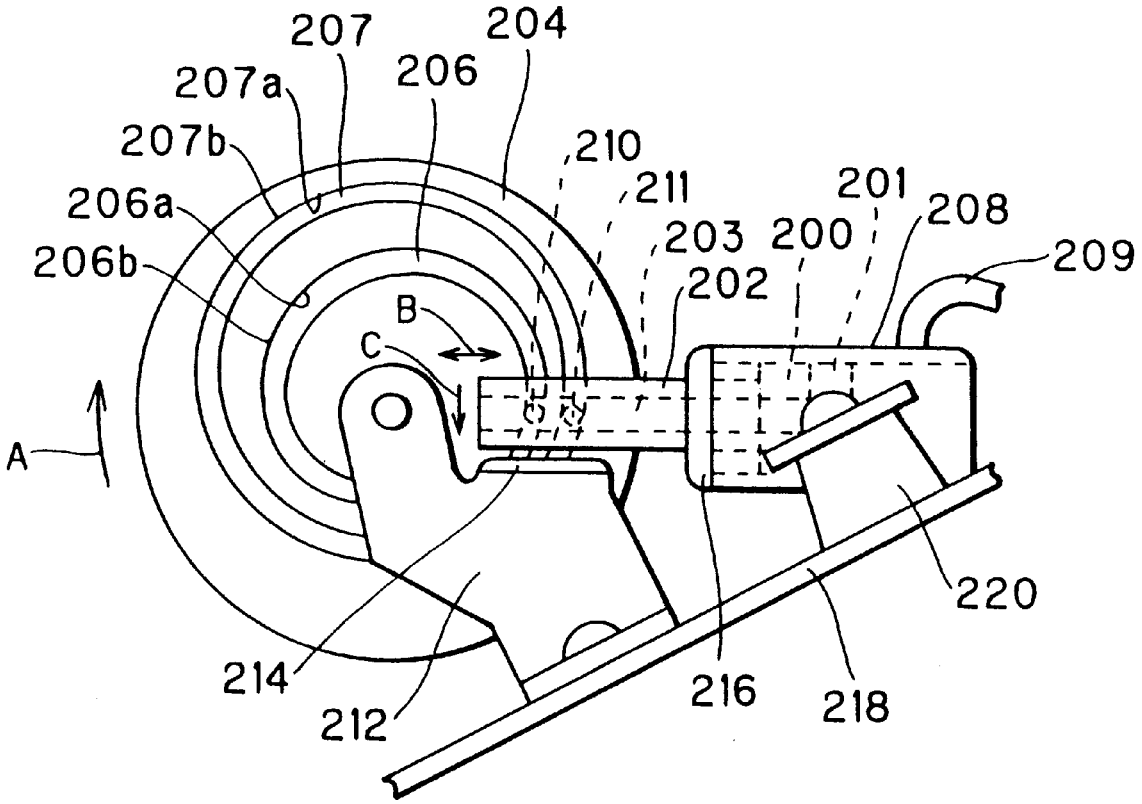
FIG. 1 is a side view of a conventional pump used on an ink purge unit of an ink jet printer.

Pumps according to preferred embodiments of the present invention will be described while referring to the accompanying drawings wherein like parts and components are designated by the same reference numerals to avoid duplicating description.

Figure 2:
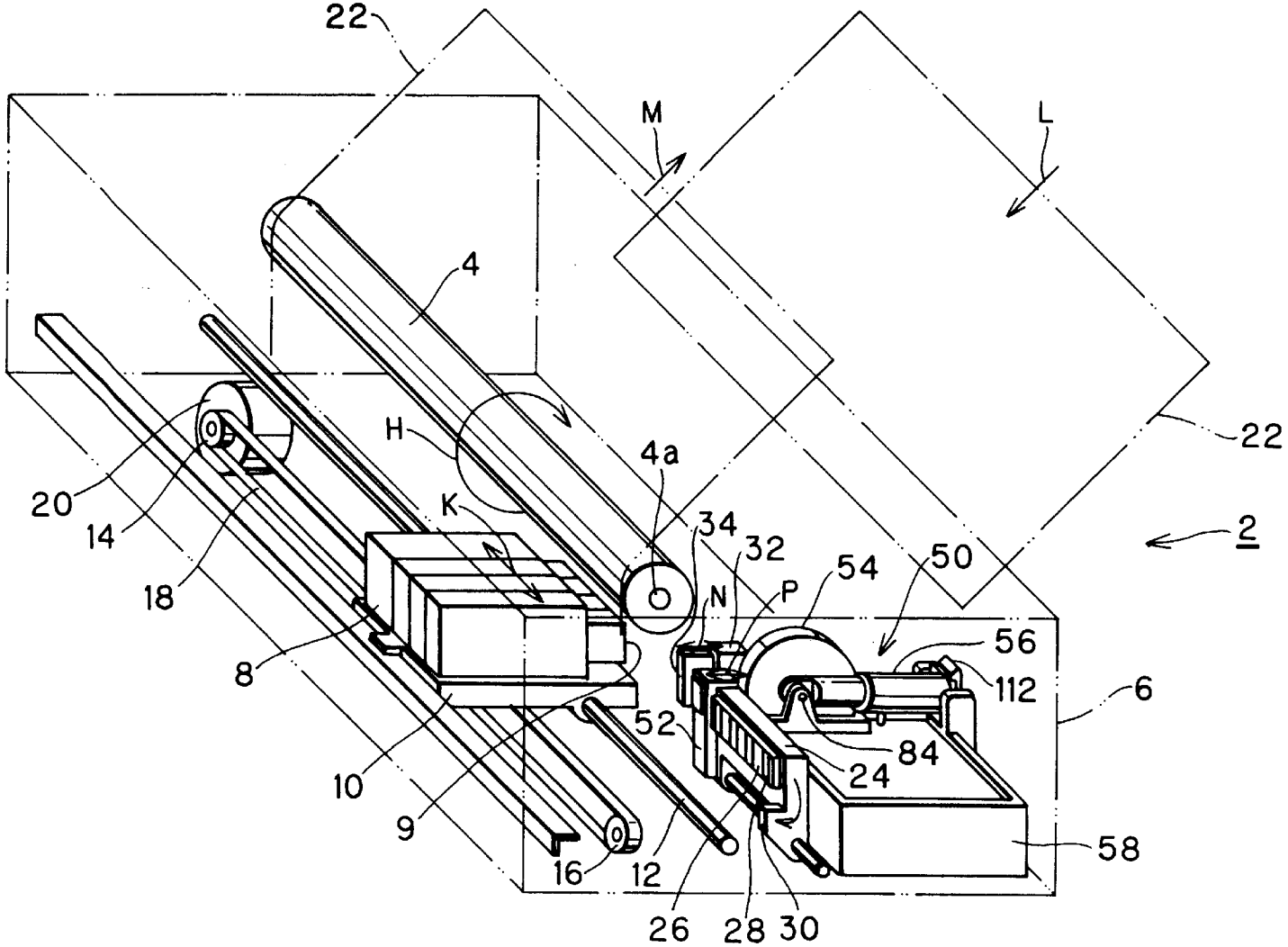
FIG. 2 is a perspective view schematically showing partially in phantom an ink jet printer including an ink suction unit having a pump according to a first embodiment of the present invention.

FIG. 2 is a schematic view showing essential portions of an ink jet printer 2 to which the present invention is applied. A cylindrical platen 4 extending in an axial direction is attached to a frame 6 on a shaft 4*a*. The platen 4 extends in an axial direction of the shaft 4*a* and the platen 4 is provided rotatable in a direction indicated by an arrow H.

An ink ejection head 8 is mounted on a carriage 10 in face to face relationship with the platen 4. The carriage 10 is slidably supported on a guide rod 12 provided in parallel with the shaft 4*a* of the platen 4. The carriage 10 is engaged with a timing belt 18 suspended between a pair of pulleys 14, 16. One of the pulleys 14 is rotated by a carriage drive motor 20. Because the timing belt 18 is wrapped around the pulley 14, rotation of the carriage drive motor 20 moves the carriage in parallel with the platen 4 in directions indicated by arrows K. In this way, the ink ejection head 8 can be reciprocally moved within a predetermined recording range.

The ink ejection head 8 includes a plurality of ink channels (not shown in the drawings) and a plurality of nozzles 9 provided in correspondence with the ink channels. Ink is supplied to the ink channels by an ink supply unit (not shown in the drawings), which is either fixed to the frame 6 or mounted the carriage 10. Walls forming the ink channels are formed from piezoelectric elements. When the piezoelectric elements are driven to deform based on commands from a control unit (not shown in the drawings), then the deformation rapidly increases pressure on the ink in the nozzles 9 so that the ink is ejected from the nozzles 9. The ejected ink impinges on a recording sheet 22 supplied between the platen 4 and the ink ejection head 8. Ink is ejected in association with movement of the carriage 10 so that one line's worth of an image is formed on the recording sheet 22. After one line's worth of image is formed, the platen 4 is rotated so that the recording sheet 22 is fed one line's distance. Then, the above-described operation is repeated so that another line's worth of an image is formed on the recording sheet 22. By repeating these operations, the entire recording sheet 22 can be formed with an image.

The recording sheet 22 is supplied in a direction indicated by an arrow L from a sheet-supply device (not shown in the drawings) attached to the rear-side of the frame 6. Rotation of the platen 4 transports the recording sheet 22 in a direction indicated by an arrow M to a sheet discharge port (not shown in the drawings) where it is discharged from the printer. A cap unit 24 is provided to the side of the platen 4 at a position in confrontation with a non-printing position of the ink ejection head 8. A rubber cap 26 formed with four rectangular recesses 28 is provided to the front surface of the cap unit 24. While printing is not being performed, the carriage 10 moves to the position of the cap unit 24. A portion of the carriage 10 engages with a protruding engagement portion 30 of the cap unit 24, so that the cap unit 24 moves in association with the carriage 10. In association with this movement, a mechanism (not shown in the drawings) causes the rubber cap 26 to protrude toward and press against the nozzles 9 of the ink ejection head 8. The indentations 28 form a sealed condition around corresponding nozzles 9 of the ink ejection head 8 so that the ink in the nozzle 9 is prevented from drying out.

A wiper unit 32 including a rubber wiper blade 34 is also provided adjacent to the platen 4. In association with the movement of the carriage 10, the rubber wiper blade 34 moves forward in a direction indicated by an arrow N and presses against the nozzles 9 as the carriage 10 passes by. In this way, the wiper blade 34 wipes off ink remaining on the front surface of the nozzles 9 after a suction operation is performed by an ink suction unit 50 provided between the wiper unit 32 and the cap unit 24.

Figure 3:
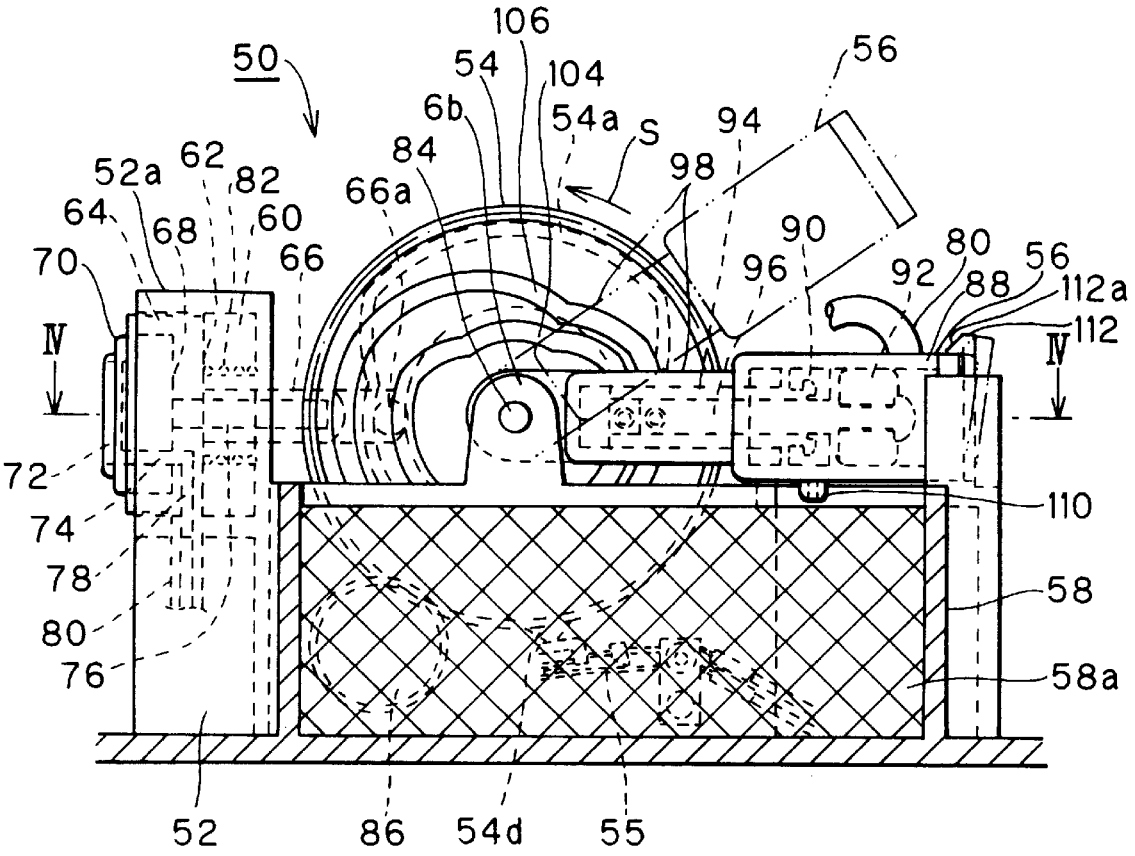
FIG. 3 is a side view showing details of the ink suction unit shown in FIG. 2.
Figure 5:
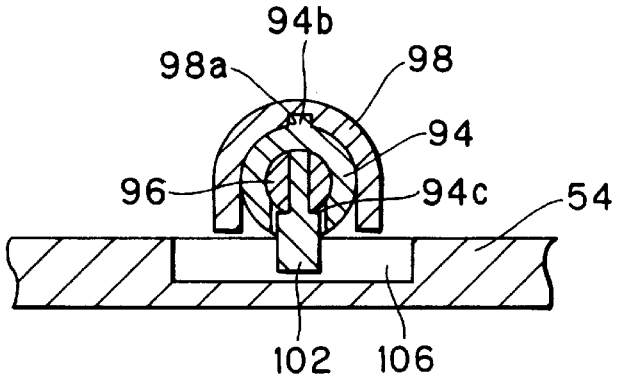
FIG. 5 is a cross-sectional view taken along line V—V of FIG. 4.
Figure 4:
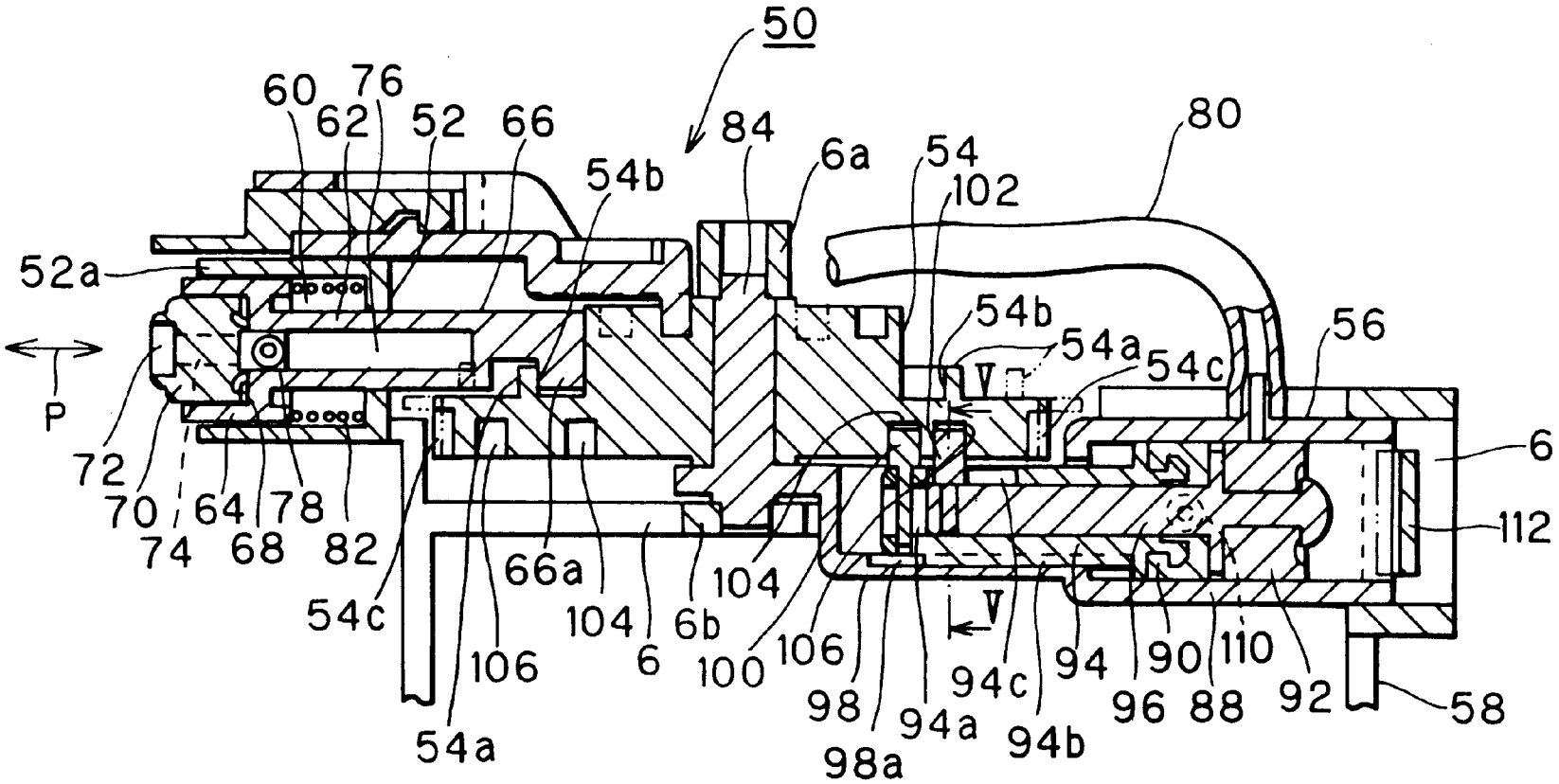
FIG. 4 is a cross-sectional view taken along line IV—IV of FIG. 3.
Figure 6A:
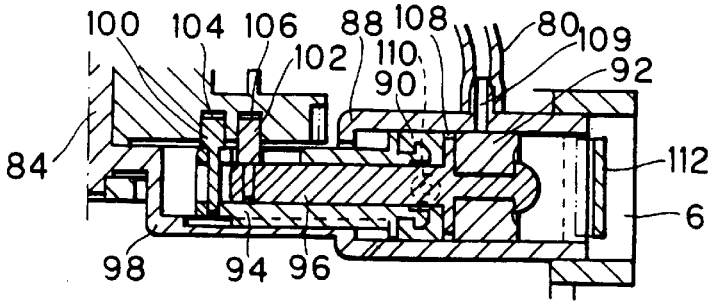
FIGS. 6(*a*) through 6(*e*) are cross-sectional views showing changes in relative positions of components of the pump according to the first embodiment during successive stages of a pumping operation.
Figure 6B:
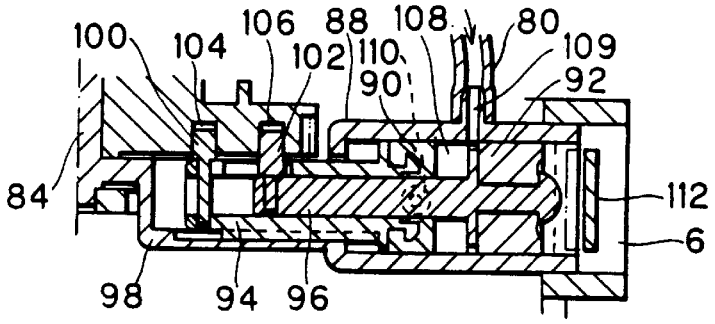
Figure 6C:
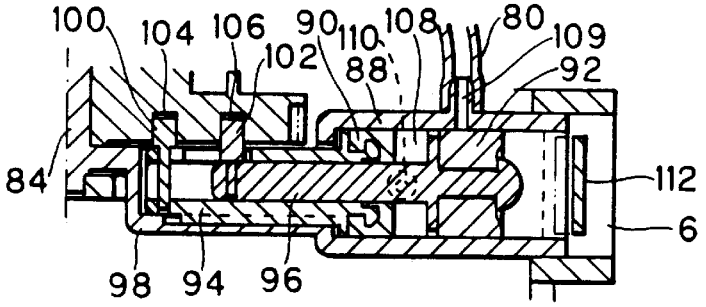
Figure 6D:
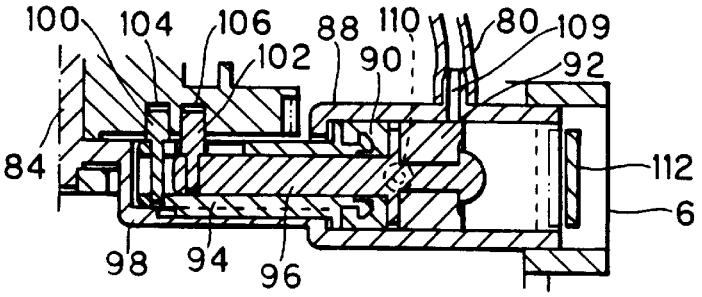
Figure 6E:
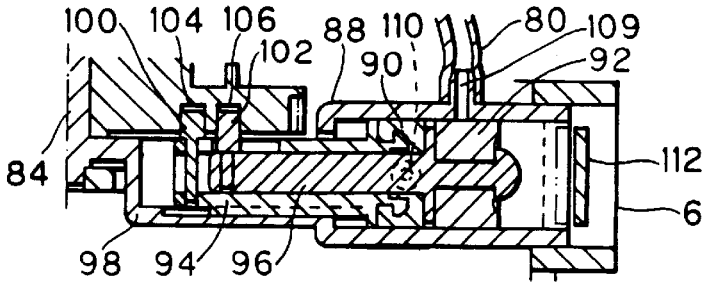

FIGS. 3 to 5 show details of the ink suction unit 50. FIG. 3 is a cross-sectional schematic view of the ink suction unit 50. FIG. 4 is a cross-sectional view taken along line IV—IV of FIG. 3. FIG. 5 is a cross-sectional view taken along line V—V of FIG. 4. The ink suction unit 50 includes a suction portion 52 having a suction portion body 52*a*, a cam 54, a pump 56, and a waste-liquid foam container 58. The suction portion 52 is disposed between the platen 4 and the cap unit 24 at a position facing a purge position in the non-print region where the injection head 8 is moved to undergo a purge operation of the nozzles 9. A housing chamber 60 opened toward the ink ejection head 8 is formed in the suction portion 52. A movement body 62 is supported within the housing chamber 60 so as to be slidable toward the ink ejection head 8. The movement body 62 includes a cap portion 64 and a movement body drive shaft 66 formed integrally together. An indentation portion 68 opening toward the purge position of the ink ejection head 8 is provided in the cap unit 24. A rubber cap 70 is provided in the indentation portion 68. A suction indentation portion 72 for fitting against the nozzles 9 of the ink jet head 8 and for sucking ink from the nozzles 9 during purge operations, that is, suction operations is provided to the front surface of the rubber cap 70. A through hole 74 in fluid communication with the indentation unit 68 of the cap portion 24 is provided to the lower edge of the suction indentation portion 72. The indentation portion 68 is in fluid communication with an internal space 76 of the movement body drive shaft 66. An ink discharge hole 78 is provided to the lower surface of the indentation portion 68. A suction tube 80 extending from the pump 56 is connected with the ink discharge hole 78. It should be noted that a coil spring 82 in a compressed condition is disposed between the body 52*a* of the suction portion 52 and the cap portion 64 of the movement body 62. The coil spring 82 urges the entire movement body 62 to protrude away from the suction portion 52.

The movement body drive shaft 66 is provided freely slidable within the suction portion body 52*a*. A cam follower 66*a* is formed at the tip of the movement body drive shaft 66 so as to protrude at a 90 degree angle to the axial direction of the shaft 66 and toward the cam 54. An annular protrusion 54*a* is provided to one surface of the cam 54. The coil spring 82 urges the cam follower 66*a* into abutment with an inner surface 54*b* of the protrusion 54*a*. Accordingly, when the distance from the rotational center of the cam 54 to the inner surface 54*b* of the annular protrusion 54*a* changes in correspondence with rotation of the cam 54, then the cap portion 64 moves in directions indicated by arrows P in correspondence with this change. Therefore, the amount that the movement body drive shaft 66 protrudes can be regulated by rotation of the cam 54.

The cam 54 is freely rotatably supported on a cam shaft 84. The cam shaft 84 is supported between bearings 6*a*, 6*b* formed in the frame 6 of the ink jet type printer 2. It should be noted that the cam 54 is formed as a gear with teeth 54*c* provided at a predetermined interval about its outer peripheral surface. A drive force transmission gear 86 is provided in meshing engagement with the teeth 54*c*. The drive force transmission gear 86 transmits drive force from a motor (not shown in the drawings) controlled by a control unit (not shown in the drawings) to rotate the cam 54 in a direction indicated by an arrow S. A protrusion 54*d* is provided at the peripheral surface of the cam 54. The protrusion 54*d* contacts a limit switch 55 at a predetermined rotational phase position of the cam 54. In this way, the control unit can detect rotational phase of the cam 54.

The pump 56 includes a cylindrically-shaped cylinder 88; a first and second rubber piston 90, 92, both disposed within the cylinder 88 so as to be slidable in an axial direction of the cylinder 88; first and second drive shafts 94, 96 attached to the first and second pistons 90, 92 respectively; and a bearing 98 substantially U-shaped in cross section and slidably supporting the first drive shaft 94. The base of bearing 98 is integrally formed with the cylinder 88 and the tip of the bearing 98 is integrally formed with the cam shaft 84 of the cam 54. A resilient holding rib 112 is provided at the side of the cylinder 88 opposite to which the bearing 98 is attached. A hook 112*a* is formed at the upper tip of the resilient holding rib 112. The cylinder 88 is sandwiched between the hook 112*a* of the resilient holding rib 112 and a portion of the frame 6 at the base of the holding rib 112. Also, the hook 112*a* restrains upward movement of the cylinder 88. The holding rib 112 absorbs movement of the cylinder 88 in the axial direction of the cylinder 88 toward the holding rib.

A bearing 94*a* is formed within the first driving shaft 94 to extend in an axial direction. The second drive shaft 96 is slidably supported by the bearing 94*a*. In this way, the first drive shaft 94 is supported on the bearing 98 and the second drive shaft 96 is supported on the bearing 98 via the first piston 90. It should be noted that an elongated protrusion 94*b* is provided to the outer periphery of the first driving shaft 94 so as to follow the axial direction of the cylinder 88. A groove 98*a* is provided in the axial direction at the inner surface of the bearing 98. The protrusion 94*b* is slidably disposed in the groove 98*a* so that the first drive shaft 94 is prevented from rotating around the bearing 98, but is slidable within the bearing 98.

First and second slide pins 100, 102 are fixed to the tips of the first and second drive shafts 94, 96 respectively so as to protrude toward the cam 54. As mentioned above, the bearing 94*a* is provided in a cylindrical space formed in the first drive shaft 94. The bearing 94*a* has a slot 94*c* elongated in an axial direction and open toward the cam 54. The second slide pin 102 fixed to the tip of the second drive shaft 96 slidably protrudes through the slot 94*c* toward the cam 54. With this configuration, the second drive shaft 96 is prevented from rotating around the first drive shaft 94 and is slidable within the first drive shaft 94. Accordingly, the second drive shaft 96 is prevented from rotating around the bearing 98 and movably supported by the first drive shaft 94.

The first slide pin 100 and the second slide pin 102 are slidably inserted in a first cam groove 104 and a second cam groove 106 respectively provided to a surface of the cam 54 opposite the surface to which the annular protrusion 54*a* is formed. Accordingly, when the cam 54 rotates, the distance from the rotational center of the cam 54 to the cam grooves 104, 106 changes. Positions of the slide pins 100, 102 change accordingly so that the slide pins 100, 102 move reciprocally toward and away from the rotation shaft 84 of the cam 54.

A detailed explanation of this operation will be provided while referring to FIGS. 6(*a*) through 6(*e*). FIG. 6(*a*) shows an initial stage of this operation. In the initial stage, the first piston 90 and the second piston 92 are in intimate contact with each other so that the volume of a pump chamber 108 defined between the first and second pistons 90, 92 and the internal wall of the cylinder 88 is substantially zero. At this time, the protrusion 54*d* of the cam 54 contacts the limit switch 55, thereby detecting that the cam 54 is in its initial rotation phase position.

When the cam 54 rotates from its initial phase shown in FIG. 6(*a*), only the distance between the second cam groove 106 and the cam shaft 84 increases. In association with this, the second piston 92 will be driven so that the volume in the pump chamber 108 will gradually increase. Because at this point the pump chamber 108 is isolated, a negative pressure is generated within the pump chamber 108. The second piston 92 continues moving away from the rotational shaft 84 of the cam 54 until, as shown in FIG. 6(*b*), it clears a suction port 109 formed in the wall of the cylinder 88 and connected to the suction tube 80. This brings the pump chamber 108 into fluid communication with the suction port 109 so that the rubber cap 70 is sealed against the nozzle plate of the ink ejection head 8 and the negative pressure built up in the pump chamber 108 draws ink from the nozzles 9 via the suction port 109, the suction tube 80, and the suction portion 52. Afterward, when the second piston 92 moves further away from the rotational shaft 84, the volume of the pump chamber 108 increases further so that, via the suction port 109, the suction tube 80, and the suction portion 52, more ink is sucked from the nozzles 9 of the ink ejection head 8 in sealed contact with the rubber cap 70.

As shown in FIG. 6(*c*), further rotation of the cam 54 decreases distance between the cam shaft 84 and both first and second cam grooves 104, 106 while maintaining the same distance between the first and second grooves 104, 106. As a result, the suction port 109 is closed by the second piston 92 and a discharge port 110 provided to a lower surface of the cylinder 88 is exposed and brought into fluid connection with the pump chamber 108 by movement of the first piston 90. Further rotation of the cam 54 closes the distance separating the second cam groove 106 and the cam shaft 84 so that only the second piston 92 moves toward the cam shaft 84. In other words, movement of the first piston 90 stops and the second piston 92 approaches the first piston 90. As a result of this, the volume in the pump chamber 108 gradually decreases so that a positive pressure is generated within the pump chamber 108. This positive pressure discharges ink from within the pump chamber 108 and into the waste-liquid foam container 58 through the discharge port 110. The discharged ink is sucked up by an ink absorbing material 58*a* within the waste liquid foam container 58.

When the second piston 92 comes into complete intimate contact with the first piston 90 as shown in FIG. 6(*d*), further rotation of the cam 54 moves both piston grooves 104, 106 away from the cam shaft 84. Therefore, the first piston 90 and the second piston 92 remain in intimate contact while moving away from the cam shaft 84 and back to the initial position shown in FIG. 6(*a*), which is also shown in FIG. 6(*e*).

In this way, rotation of the cam 54 changes the distance separating the cam grooves 104, 106 from the cam shaft 84. This moves the first piston 90 and the second piston 92 in a manner described above so that they operate as a suction pump. The rubber first piston 90 and second piston 92 are inserted into the cylinder 88 to form a highly fluid-tight seal. For this reason, a large force is required to move the pistons 90, 92 within the cylinder 88. Accordingly, a large force is applied from the cam 54 to both of the slide pins 100, 102 not only in the axial direction of the cylinder 88, but also in a direction perpendicular to the axial direction. This large force pushes upward against the tips of the first drive shaft 94 and the second drive shaft 96.

However, as described above, both the first drive shaft 94 and the second drive shaft 96 are supported on the bearing 98; the bearing 98 is integrally formed at its base with the cylinder 88 and at its tip with the cam shaft 84 of the cam 54; and the cylinder 88 is held in place at its end opposite the bearing 98 by the resilient holding rib 112 and the frame 6. Because the cam 54 rotates in a direction indicated by the arrow S, even if the force from the cam 54 operates on the cylinder 88 via the bearing 98, the force will be applied to the resilient holding rib 112. Therefore, the cylinder 88 will not move from its fixed position.

The bearing 98, which supports the first drive shaft 94 and the second drive shaft 96, is fixed to and supported by the cam shaft 84 at one end and the cylinder 88, which is supported on the frame 6, at the opposite end. With this configuration, force from the cam 54 is applied to the middle of the bearing 98. Therefore, force from the cam 54 in the direction perpendicular to the axial direction of the cylinder 88 is distributed to the left and right sides of the bearing 98 as viewed in FIG. 4 with a portion of the force being applied to the frame 6 via the cam shaft 84 and the rest being applied to the frame 6 via the cylinder 88 and the resilient holding rib 112. For this reason, a large moment will not develop on either the cam shaft 84 side nor the cylinder 88 side of the bearing 98. Therefore, a sturdy support portion is not needed to support the cylinder so a simple resilient holding rib 112 is sufficient for supporting the cylinder 88.

Further, because the bearing 98 provided to one tip of the cylinder 88 to support and fix the cylinder 88 in place extends in a straight line toward the cam shaft 84 and is fixed to the tip of the cam shaft 84, the cylinder 88 has a direct relationship to the cam 54 via the bearing 98, which is integrally formed with the cylinder 88. The position of the cylinder 88 with regard to the position of the cam 54 is therefore determined by the bearing 98.

That is to say, if the bearing 98 is formed into a precise shape, then the cylinder 88 will be accurately and precisely positioned merely by assembling the mechanism. In contrast, were the cam 54 and the cylinder 88 to be supported separately and independently on the frame, then these components would be difficult to accurately and precisely assemble. However, accurate and precise assembly can be easily achieved with the configuration according to the present embodiment. As shown by two-dot chain line shown in FIG. 3, to install the pump 56, the cam shaft 84 at the tip of the bearing 98 is first inserted through the center hole of the cam 54. After both tips of the cam shaft 84 are fitted to the bearings 6*a*, 6*b* of the frame 6, the cam 54 is rotated around the cam shaft 84 until the cylinder 88 is brought into the abutment with the frame 6. Then, the hook 112*a* of the resilient holding rib 112 snaps into abutment with the upper surface of the cylinder 88, thereby preventing vertical movement of the cylinder 88 and holding it in place. This allows accurate and precise assembly to be performed easily so that manufacturing costs can be reduced.

There is also no need to provide a cap 216 or a complicated support member 212 for the cam. Since the number of components is reduced, manufacturing costs can be further reduced.

Although in the above-described embodiment the cam was described as rotating in a direction indicated by an arrow S in FIG. 3, by forming the first and second cam channels 104, 106 on the opposite side of the cam 54, the cam 54 can be formed to be rotated in a direction opposite the direction shown by the arrow S.

That is to say, when the cam 54 is rotated in a direction opposite to the direction indicated by the arrow S, the tips of the first drive shaft 94 and the second drive shaft 96 will be forced downward. For this reason, as described in the above embodiment, there is no need to forcefully regulate upper movement of the cylinder 88 by hook 112*a* of the resilient holding rib 112. Therefore, the resilient holding rib 112 need not be sturdily formed.

Figure 7:
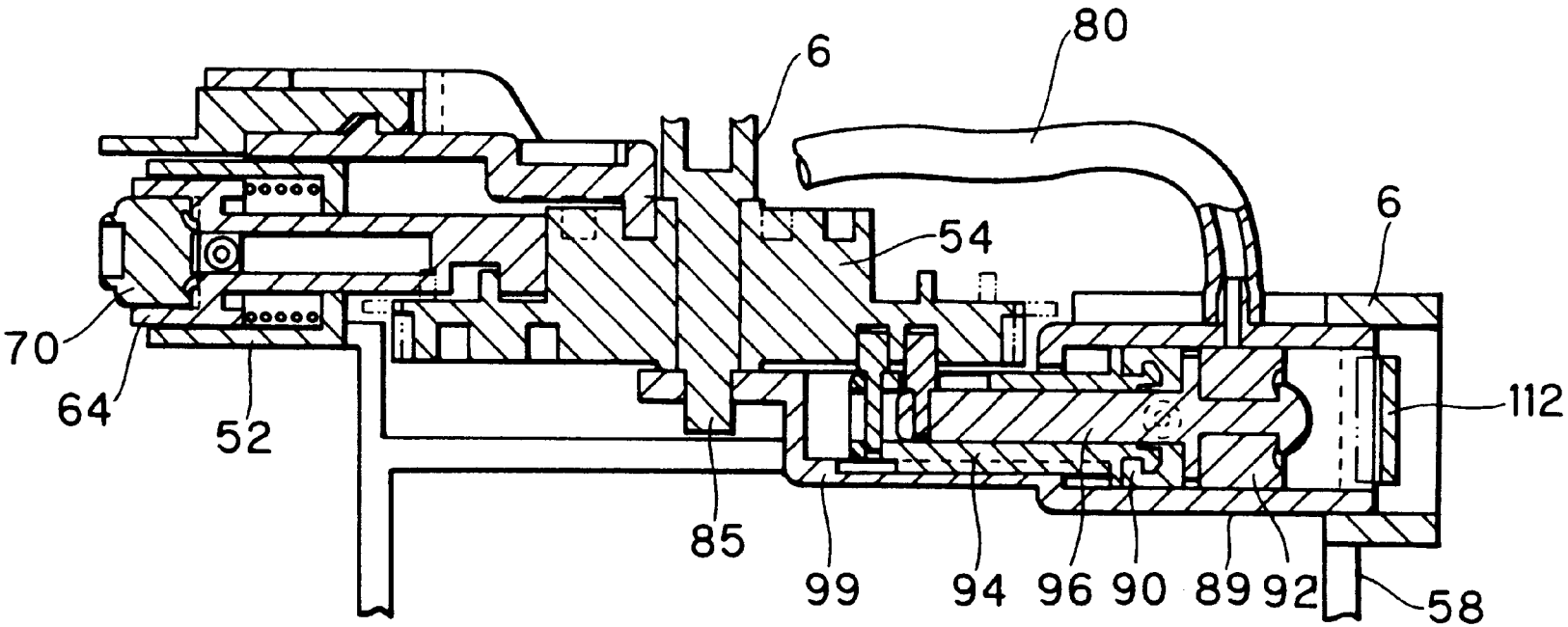
FIG. 7 is a cross-sectional view showing a suction purge unit including a pump according to a second embodiment of the present invention.

In the first embodiment, the bearing 98 is supported on the cam shaft 84 by forming the bearing 98 integrally with the cam shaft 84 of the cam 54. However, according to a second embodiment, as shown in FIG. 7, a cam shaft 85 is formed integrally with the frame 6. After sliding the cam 54 onto the cam shaft 85, a bearing 99 is fixed to the opposite tip of the cam shaft 85. In this way, the same effects as described in the first embodiment can be achieved. It should be noted that in the second embodiment, the free tip of the cam shaft 85 is supported on the frame 6.

Figure 8:
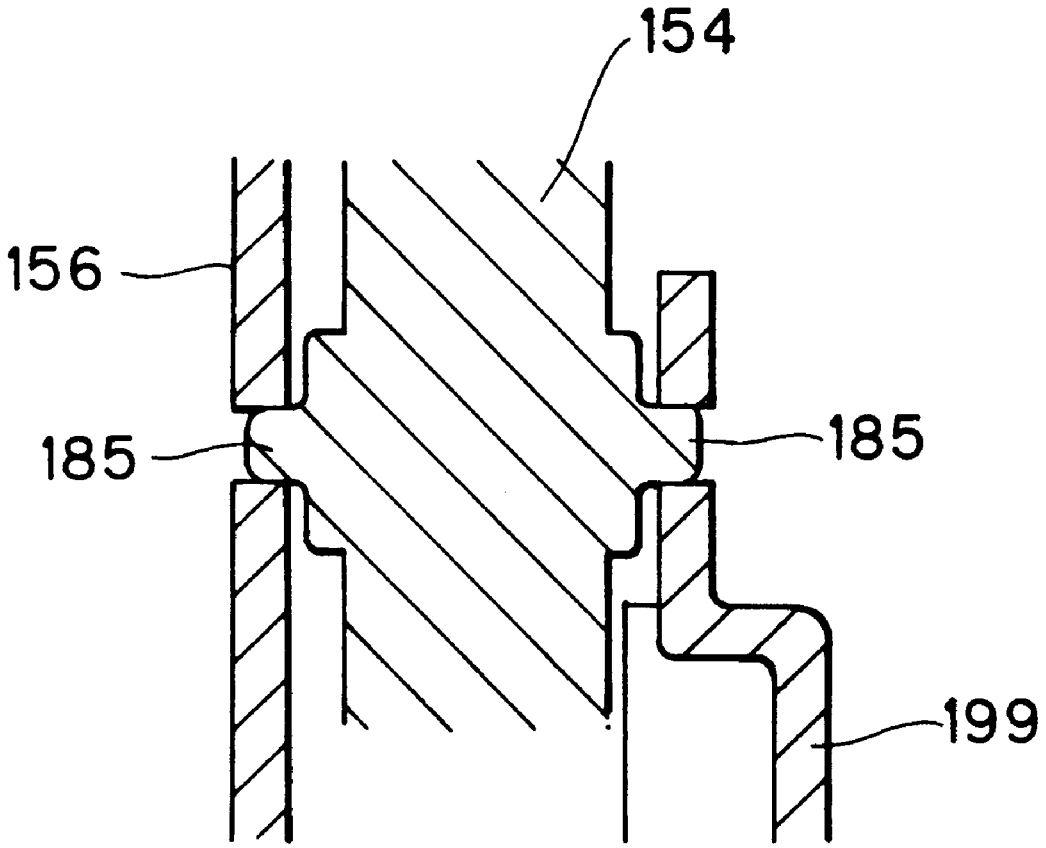
FIG. 8 is a cross-sectional view showing configuration for supporting a cam of a pump according to a third embodiment of the present invention.

FIG. 8 shows configuration for supporting a cam 154 of a pump according to a third embodiment of the present invention. In the third embodiment, cam shaft 185 is formed integrally with the cam 154. The cam shaft 185 is supported freely rotatable with respect to a frame 156 and a cylinder bearing 199.

With the structures described in the embodiments, the cylinder of the pump is supported at at least two support points and the cam shaft rotatably supporting the cam is provided at at least one of the two support points supporting the cylinder. Therefore, the cylinder and the cam are in direct association with each other so that the cylinder can be accurately and precisely positioned with respect to the cam by merely assembling components so that the cylinder is supported by the cam shaft of the cam.

In the above-described embodiments, the point where the cam and the drive shaft contact is sandwiched between the two support points of the cylinder, that is, between the support point where the cam shaft is provided and another support point. Therefore, any vibrating force that the cam applies to the drive shaft is distributed to the two support points without the cylinder acting as a lever and amplifying the force at either of the support points. Therefore, even if the support portion supporting the cylinder is not very sturdily formed, the cylinder can be strongly supported so as not to vibrate. As a result, effects from vibration of the cylinder can be eliminated.

When the cylinder, which is sturdily supported as described above, includes a bearing for supporting the drive shaft, then the vibration in the axial direction of the drive shaft can be completely prevented from effecting the cylinder so that precision of the pump is further increased.

The cylinder support point where the cam rotational shaft is positioned need not be connected directly to the cylinder. Instead the bearing provided to the cylinder could serve as the support point for the cam rotational shaft. With this structure, the cylinder is supported by the cam rotational shaft, which serves as one of the support points via the bearing.

It should be noted that the pumps described in the embodiments are provided with two pistons and two drive shafts with the pump chamber being formed between the two pistons. Because the first drive shaft is supported by a bearing provided in the cylinder and the second drive shaft is supported in a bearing provided in the first drive shaft, then the second drive shaft is also supported by the bearing provided in cylinder, although via the first drive shaft. With this configuration, vibration from both of the drive shafts can be prevented from propagating to the cylinder.

Because the pump has a comparatively simple configuration, it is particularly applicable for use in a purge unit for sucking ink from an ink ejection head of an ink jet printer.

What is claimed is:

1. A pump for performing suction and discharge of a liquid, comprising:

a cylinder including a cylinder bearing, the cylinder being supported at at least a first support point and a second support point;

a first piston slidably disposed in the cylinder and forming a pump chamber having a volume changeable by sliding movement of the first piston;

a first drive shaft, the first piston and the first drive shaft moving in association with each other;

a cam in contact with the first drive shaft so that rotation of the cam drives the first drive shaft to move, the first piston sliding within the cylinder in association with movement of the first drive shaft to perform suction and discharge of a liquid; and a cam shaft rotatably supporting the cam and supported at the first support point, wherein the second support point is positioned outside a reciprocal movement region of the first piston and beyond a top dead center of the first piston, relative to the first support point, and wherein the cylinder bearing supports the first drive shaft.

2. A pump as claimed in claim 1, wherein the cylinder bearing is integrally formed with the cam shaft.

3. A pump as claimed in claim 2, wherein the cylinder is supported at a first end thereof at the first support point via the cylinder bearing and at a second end thereof opposite the first end in an axial direction of the cylinder at the second support point.

4. A pump as claimed in 3, further comprising:

a resilient rib disposed at the second support point and absorbing movement of the cylinder toward the rib in the axial direction of the cylinder; and a frame supporting the cam shaft and the resilient rib.

5. As claimed in claim 4, wherein:

the cylinder bearing is fixed to the cam shaft and the cylinder is provided rotatable about the cam shaft via the cylinder bearing; and the rib includes a hook for hooking the cylinder and preventing rotation of the cylinder about the cam shaft.

6. A pump as claimed in claim 2, further comprising:

a second piston slidably disposed in the cylinder; and a second drive shaft connected to the second piston and in contact with the cam, the pump chamber being defined by the first piston, the second piston, and the cylinder.

7. A pump as claimed in claim 6, wherein the first drive shaft is supported by the cylinder bearing of the cylinder and is formed with a shaft bearing supporting the second drive shaft.

8. A pump as claimed in claim 7 wherein the cylinder is formed with a groove extending in an axial direction of the cylinder and the first drive shaft is formed with an enlongated protrusion slidably disposed in the groove of the cylinder.

9. A pump as claimed in claim 8, wherein:

the cam is formed with an annular first groove and an annular second groove both respectively separated from the cam shaft by distances varying with phase of the cam; and the first drive shaft and the second drive shaft are provided at their tips with a first pin and a second pin respectively inserted in the first groove and the second groove respectively so that the pistons slide in the cylinder in association with phase of the cam.

10. A pump as claimed in claim 9, wherein the first drive shaft is formed with a slot, the second pin of the second drive shaft protruding through the slot toward the cam.

11. A pump as claimed in claim 6 wherein:

the cam is formed with an annular first groove and an annular second groove both respectively separated from the cam shaft by distances varying with phase of the cam; and the first drive shaft and the second drive shaft are provided at their tips with a first pin and second pin respectively inserted in the first groove and the second groove respectively so that the pistons slide in the cylinder in association with phase of the cam.

12. A pump as claimed in claim 2, wherein the cylinder is formed with a groove extending in an axial direction of the cylinder and the first drive shaft is formed with an elongated protrusion slidably disposed in the groove of the cylinder.

13. A pump as claimed in claim 1, further comprising:

a second piston slidably disposed in the cylinder; and a second drive shaft connected to the second piston and in contact with the cam, the pump chamber being defined by the first piston, the second piston, and the cylinder.

14. A pump as claimed in claim 13, wherein the first drive shaft is supported by the cylinder bearing of the cylinder and is formed with a shaft bearing supporting the second drive shaft.

15. A pump as claimed in claim 13, wherein:

the cam is formed with an annular first groove and an annular second groove both respectively separated from the cam shaft by distances varying with phase of the cam; and the first drive shaft and the second drive shaft are provided at their tips with a first pin and a second pin respectively inserted in the first groove and the second groove respectively so that the pistons slide in the cylinder in association with phase of the cam.

16. A pump as claimed in claim 1, wherein the bearing protrudes linearly in an axial direction of the cylinder toward the cam shaft and is supported at the first support point.

17. A pump as claimed in claim 1, wherein the cam and the first drive shaft contact at a point between the first support point and the second support point.

18. A pump as claimed in claim 1, wherein the cylinder is supported at a first end thereof at the first support point and at a second end thereof opposite the first end in an axial direction of the cylinder at the second support point.

19. A pump as claimed in 18, further comprising:

a resilient rib disposed at the second support point and absorbing movement of the cylinder toward the rib in the axial direction of the cylinder; and a frame supporting the cam shaft and the resilient rib.

20. As claimed in claim 19, wherein:

the cylinder bearing is fixed to the cam shaft and the cylinder is provided rotatable about the cam shaft via the cylinder bearing; and the rib includes a hook for hooking the cylinder and preventing of the cylinder about the cam rotational shaft.

21. A pump as claimed in claim 1, wherein the cam and the first drive shaft contact at a point between the first support point and the second support point.

22. A pump as claimed in claim 1, wherein the pump is provided to an ink jet printer for sucking ink from an ink jet head of the printer.

23. A pump as claimed in claim 1, further comprising a frame formed integrally to the cam shaft.

24. A pump as claimed in claim 1, further comprising a frame, the cam shaft provided freely rotatably with respect to the frame and the cylinder bearing.

25. A pump as claimed in claim 1, wherein the cylinder bearing is supported at the first support point.

26. A pump for performing suction and discharge of a liquid, comprising:

a cylinder including a cylinder bearing, the cylinder being supported at a first end thereof at a first support point and at a second end thereof opposite the first end in an axial direction of the cylinder at a second support point;

a first piston slidably disposed in the cylinder and forming a pump chamber having a volume changeable by sliding movement of the first piston;

a first drive shaft, the first piston and the first drive shaft moving in association with each other;

a cam in contact with the first drive shaft so that rotation of the cam drives the first drive shaft to move, the first piston sliding within the cylinder in association with movement of the first drive shaft to perform suction and discharge of a liquid;

a cam shaft rotatably supporting the cam and supported at the first support point;

a resilient rib disposed at the second support point and absorbing movement of the cylinder toward the rib in the axial direction of the cylinder; and a frame supporting the cam shaft and the resilient rib, wherein the second support point is positioned outside a reciprocal movement region of the first piston and beyond a top dead center of the first piston, relative to the first support point.

27. A pump as claimed in claim 26, wherein:

the cylinder bearing is fixed to the cam shaft and the cylinder is provided rotatable about the cam shaft via the cylinder bearing; and the rib includes a hook for hooking the cylinder and preventing rotation of the cylinder about the cam shaft.

28. A pump for performing suction and discharge of a liquid, comprising:

a cylinder including a cylinder bearing, he cylinder being supported at at least a first support point and a second support point;

a first piston slidably disposed in the cylinder and forming a pump chamber having a volume changeable by sliding movement of the first piston;

a first drive shaft, the first piston and the first drive shaft moving in association with each other;

a cam in contact with the first drive shaft so that rotation of the cam drives the first drive shaft to move, the first piston sliding within the cylinder in association with movement of the first drive shaft to perform suction and discharge of a liquid; and a cam shaft rotatably supporting the cam and supported at the first support point, wherein the second support point is positioned outside a reciprocal movement region of the first piston and beyond a top dead center of the first piston, relative to the first support point, and wherein the pump is provided to an ink jet printer for sucking from an ink jet head of the printer.

* * * * *